US008665288B2

(12) United States Patent
Hsu et al.

(10) Patent No.: US 8,665,288 B2
(45) Date of Patent: Mar. 4, 2014

(54) COLOR TRACKING METHOD FOR PANEL AND ASSOCIATED MODIFYING MODULE

(75) Inventors: Te-Wei Hsu, New Taipei (TW); Tung-Han Sung, New Taipei (TW); Chuan-Tsung Chen, Taoyuan County (TW)

(73) Assignee: MStar Semiconductor, Inc., Hsinchu County (TW)

( * ) Notice: Subject to any disclaimer, the term of this patent is extended or adjusted under 35 U.S.C. 154(b) by 192 days.

(21) Appl. No.: 13/305,031

(22) Filed: Nov. 28, 2011

(65) Prior Publication Data

US 2013/0016117 A1 Jan. 17, 2013

(30) Foreign Application Priority Data

Jul. 15, 2011 (TW) ..... 100125216 A

(51) Int. Cl.
*G09G 5/02* (2006.01)

(52) U.S. Cl.
USPC ..... 345/589

(58) Field of Classification Search
None
See application file for complete search history.

(56) References Cited

U.S. PATENT DOCUMENTS

| | | | | |
|---|---|---|---|---|
| 7,075,552 | B2 * | 7/2006 | Herbert et al. | 345/589 |
| 7,218,358 | B2 * | 5/2007 | Chen et al. | 348/658 |
| 7,777,756 | B2 * | 8/2010 | Kwak et al. | 345/589 |
| 2009/0128578 | A1 * | 5/2009 | Feng | 345/600 |
| 2010/0259555 | A1 * | 10/2010 | Hibi et al. | 345/601 |

* cited by examiner

*Primary Examiner* — Aaron M Richer
*Assistant Examiner* — Nicholas R Wilson
(74) *Attorney, Agent, or Firm* — WPAT, PC; Justin King

(57) ABSTRACT

A color tracking method for a panel and an associated modifying module are provided. A set of measured display values are obtained according to a measurement of the panel by a color meter and the measured display values are modified. Display settings of the panel are then calculated according to the modified display values.

10 Claims, 4 Drawing Sheets

COLOR TRACKING METHOD FOR PANEL AND ASSOCIATED MODIFYING MODULE

This application claims the benefit of Taiwan application Serial No. 100125216, filed Jul. 15, 2011, the subject matter of which is incorporated herein by reference.

BACKGROUND OF THE INVENTION

1. Field of the Invention

The invention relates in general to a color tracking method for a panel and an associated modifying module, and more particularly, to a method for enhancing color tracking accuracy through modifying display values measured by a color meter and an associated modifying module.

2. Description of the Related Art

Display panels, e.g., color liquid crystal display (LCD) panels for monitors and televisions, being capable of presenting diversified multimedia information, have become essential parts of the modern information society.

Stereotypical conventional Information playback operations of a display panel are described as follows. The panel is driven by a controller (e.g., a control chip), which receives a video stream comprising a series of input values from a signal source. The controller then provides driving signals to pixels of the panel according to the series of input values, so as to drive the pixels to display. Each input value (r_in, g_in, b_in) includes three input components, e.g., a red component r_in, a green component g_in and a blue component b_in, each of which may have a value between 0 and 255. That is, with different combinations of input component values, the input value is able to describe 256*256*256 different colors.

However, due to discrepancies in characteristics of different panels, actual colors presented by the different panels with the same input values corresponding to driving signals may be different. To compensate the discrepancies between the panels, the controller needs to perform color tracking on the panels individually. In color tracking, a color meter first measures colors displayed on a display panel to obtain measured results; according to the measured results, display settings are then adjusted to normalize display effects, so that the display effects of the colors displayed on the different panels are inclined to consistency. For example, color temperatures of different grayscales of different panels are tuned to approximate a same target temperature (e.g., 6500 Kelvin degrees). For example, the color meter can be a color temperature meter for measuring a display value (X, Y, Z) of a color displayed on the panel. The display value (X, Y, Z) includes three display components X, Y and Z. It is to be noted that, a value of the display component Y alone corresponds to a brightness of a color, and a color temperature of a color is determined by values of the three display components X, Y, and Z. The controller for controlling the panel converts the input components of the input values into corresponding driving signals according to display settings.

A conventional color tracking approach is to be described below. In the prior art, pixels of a panel sequentially receive a total of Np number of grayscale blending input values W(1)=(vin(1), vin(1), vin(1)), W(2)=(vin(2), vin(2), vin(2)), . . . W(Np)=(vin(Np), vin(Np), vin(Np)). Each of the input values includes three input components (r_in, g_in, b_in), as previously mentioned. The Np number of grayscale blending input values respectively correspond to a grayscale brightness W(i), where i=1 to Np. While receiving the grayscale blending input values, the color meter measures the corresponding Np display values Wp(1)=(Xw(1), Yw(1), Zw(1)), Wp(2)=(Xw(2), Yw(2), Zw(2)), . . . Wp(Np)=(Xw(Np), Yw(Np), Zw(Np)). Each of the display values includes three display components (X, Y, Z), as previously mentioned. The display values also respectively correspond to a measured grayscale brightness Wp(i), where i=1 to Np. In addition, the panel may also receive and display three monochromatic input values R(Np)=(vin(Np), 0, 0), G(Np)=(0, vin(Np), 0), and B(Np)=(0, 0, vin(Np)), which respectively correspond to a monochromatic brightness R(Np), G(Np), and B(Np). Three corresponding display values Rp(Np)=(Xr(Np), Yr(Np), Zr(Np)), Gp(Np)=(Xg(Np), Yg(Np), Zg(Np)) and Bp(Np)=(Xb(Np), Yb(Np), Zb(Np)) are then measured. Similarly, the three display values may respectively correspond to a measured monochromatic brightness Rp(Np), Gp(Np), and Bp(Np).

Based on color synthesis theories, grayscale blending input values (vin(Np), vin(Np), vin(Np)) are synthesized from the three monochromatic input values (vin(Np), 0, 0), (0, vin(Np), 0) and (0, 0, vin(Np)), i.e. R(np)+G(Np)+B(Np)=W(Np). Similarly, the display value (Xw(Np), Yw(Np), Zw(Np)) shares the same feature; that is, Rp(Np)+Gp(Np)+Bp(Np)=Wp(Np). Furthermore, the display component Xw(Np) is theoretically equal to a sum Xr(Np)+Xg(Np)+Xb(Np) of the display components Xr(Np), Xg(Np), and Xb(Np), and the display component Zw(Np) is theoretically equal to a sum Zr(Np)+Zg(Np)+Zb(Np) of the display components Zr(Np), Zg(Np), and Zb(Np).

In the prior art, it is assumed based on color synthesis theories that, Xw(i)=Xr(i)+Xg(i)+Xb(i), Yw(i)=Yr(i)+Yg(i)+Yb(i), and Zw(i)=Zr(i)+Zg(i)+Zb(i). It is also assumed that the ratio of Rp(i) to Wp(i), the ratio of Gp(i) to Wp(i), and the ratio of Bp(i) to Wp(i) are maintained almost unchanged within a range between i=1 and Np. Thus, interpolation is performed on the display values (Xr(Np),Yr(Np),Zr(Np)), (Xg(Np),Yg(Np),Zg(Np)), (Xb(Np),Yb(Np),Zb(Np), and (Xw(1),Yw(1),Zw(1)), as well as (Xw(Np),Yw(Np),Zw(Np)) to obtain a display value (Xr(i), Yr(i), Zr(i)) corresponding to the input value (vin(i), 0, 0), a display value (Xg(i), Yg(i), Zg(i)) corresponding to the input value (0, vin(i), 0), and a display value (Xb(i), Yb(i), Zb(i)) corresponding to the input value (0, 0, vin(i)), where i=1 to (Np−1). According to the display values obtained through interpolation, a corresponding display setting may be obtained through a display setting algorithm.

However, in practice, it is discovered that not only grayscale color temperatures are inconsistent but also the grayscale color temperatures cannot reach the target temperatures after the adjustment in the prior art, such that certain offset exists between the grayscale color temperatures and the target color temperature. Therefore, there is a need for a solution for improving the prior color tracking technique in the prior art.

SUMMARY OF THE INVENTION

According to the present invention, the prior color tracking technique suffers from a drawback caused by an erroneous synthesis assumption on display components. Supposing when input values are in sequence R(i)=(vin(i),0,0), G(i)=(0, vin(i),0), B(i)=(0,0,vin(i)), and W(i)=(vin(i),vin(i),vin(i)), display values measured by a color meter are Rp(i)=(Xr(i), Yr(i),Zr(i)), Gp(i)=(Xg(i),Yg(i),Zg(i)), Bp(i)=(Xb(i),Yb(i), Zb(i)), and Wp(i)=(Xw(i),Yw(i),Zw(i)), which are inconsistent with Xw(i)=Xr(i)+Xg(i)+Xb(i), Yw(i)=Yr(i)+Yg(i)+Yb(i), and Zw(i)=Zr(i)+Zg(i)+Zb(i). That is to say, with the actual measured display components Kw(i), Kr(i), Kg(i), and Kb(i), the display component Kw(i) does not equal to Kr(i)+Kg(i)+Kb(i). The difference between the display components Kw(i) and Kr(i)+Kg(i)+Kb(i) is possibly resulted by light leakage or panel characteristics. Since the prior art operates based on the assumption that Kr(i)+Kg(i)+Kb(i)=Kw(i), the difference then implies that the prior art may fail to successfully accomplish accurate color tracking. In contrast, according to the present invention, display components Xc(i), Yc(i), and Zc(i) in the measured display value (Xc(i), Yc(i), Zc(i)) are first modified (where c represents one of r, g, and b), and a display setting is adjusted according to the modified display values, so as to accurately fulfill color tracking.

A color tracking method for a panel is provided according to an embodiment of the present invention. The method includes obtaining a set of measured display values according to a measurement of the panel by a color meter and modifying the measured display values, and calculating a display setting for the panel to display according to the modified display values.

The set of measured display values includes a plurality of monochromatic display components Kr(i), Kg(i), and Kb(i) as well as a grayscale blending display component Kw(i), where K represents one of X, Y, and Z. According to a difference between the grayscale blending display component Kw(i) and the monochromatic display components Kr(i), Kg(i), and Kb(i), corresponding monochromatic modification values ΔKr(i), ΔKg(i), and ΔKb(i) are respectively provided to the monochromatic display components Kr(i), Kg(i), and Kb(i). The display value is modified according to the monochromatic component Kc(i) and the corresponding monochromatic modification value ΔKc(i), wherein c represents one of r, g, and b.

In an embodiment, a display component sum Kr(i)+Kg(i)+Kb(i) is calculated from the monochromatic components Kr(i), Kg(i), and Kb(i), and an offset value ΔKw(i) is provided according to a difference between the grayscale blending display component Kw(i) and the display component sum.

Corresponding distribution ratios Ksr(i), Ksg(i), and Ksb(i) are respectively set for the monochromatic display components Kr(i), Kg(i), and Kb(i), and the monochromatic modification values ΔKr(i), ΔKg(i), and ΔKb(i) are calculated according to the distribution ratios Ksr(i), Ksg(i), and Ksb(i) as well as the offset value ΔKw(i). For example, it is set that ΔKc(i)=Ksc(i)*ΔKw(i), where c represents one of r, g, and b, K represents one of X, Y, and Z, and Ksr(i)+Ksg(i)+Ksb(i)=1.

In an embodiment, the distribution ratio is set according to a relative ratio of the monochromatic components Kr(i), Kg(i) and Kb(i). For example, it is set that Ksc(i)=Kc(i)/(Kr(i)+Kb(i)+Kg(i)), where K represents one of X, Y and Z, and c represents one of r, g, and b.

In an embodiment, the monochromatic display components Yr(i), Yg(i), and Yb(i) are designated as reference monochromatic reference display components, so as to set the distribution ratio Ksc(i) for the monochromatic display component Kc(i) according to a relative ratio of the reference monochromatic display components. For example, distribution ratios Xsr(i), Xsg(i), and Xsb(i) corresponding to the monochromatic display components Xr(i), Xg(i), and Xb(i) are respectively set to Yr(i)/(Yr(i)+Yg(i)+Yb(i)), Yg(i)/(Yr(i)+Yg(i)+Yb(i)), and Yb(i)/(Yr(i)+Yg(i)+Yb(i)).

In an embodiment, monochromatic display components Yr(i0), Yg(i0), and Yb(i0) corresponding to a predetermined variable i0 are designated as reference monochromatic display components, and the distribution ratio Ksc(i) of the monochromatic display component Kc(i) is set according to a relative ratio of the reference monochromatic display components, where the variable i does not equal to the variable i0. For example, the distribution ratios Ksr(i), Ksg(i), and Ksb(i) corresponding to the monochromatic display components Kr(i), Kg(i), and Kb(i) may respectively equal to Yr(i0)/(Yr(i0)+Yg(i0)+Yb(i0)), Yg(i0)/(Yr(i0)+Yg(i0)+Yb(i0)) and Yb(i0)/(Yr(i0)+Yg(i0)+Yb(i0)). Alternatively, the distribution ratio Ksc(i) corresponding to the monochromatic display component Kc(i) may equal to Kc(i0)/(Kr(i0)+Kg(i0)+Kb(i0)).

In an embodiment, the distribution ratios Ksr(i), Ksg(i), and Ksb(i) may be constants independent from a measurement.

According to sums Kr(i)+ΔKr(i), Kg(i)+ΔKg(i), and Kb(i)+ΔKb(i) of the monochromatic display components Kr(i), Kb(i), and Kg(i) and the corresponding monochromatic modification values ΔKr(i), ΔKg(i), and ΔKb(i), corresponding modified monochromatic display components Kr_m(i), Kg_m(i), and Kb_m(i) may be calculated to replace the original monochromatic display components Kr(i), Kg(i), and Kb(i) in the modified display values.

After replacing and modifying with the modified display values, a sum Kr_m(i)+Kg_m(i)+Kb_m(i) of the modified monochromatic display components is then consistent with the grayscale blending display component Kw(i). By adjusting a display setting according to modified display values (Xr_m(i), Yr_m (i), Zr_m (i)), (Xg_m (i), Yg_m (i), Zg_m (i)), and (Xb_m (i), Yb_m (i), Zb_m (i)), color tracking may be achieved accurately to allow the grayscale color temperatures to approximate a target color temperature.

In an embodiment, the present invention repeats the following steps to measure with different variables i. A color meter is utilized to measure monochromatic display values (measured display values) Rp(i)=(Xr(i), Yr(i), Zr(i)), Gp(i)=(Xg(i), Ygr(i), Zg(i)), and Bp(i)=(Xb(i), Yb(i), Zb(i)) corresponding to three monochromatic input values R(i)=(r_in(i), 0, 0), G(i)=(0, g_in(i), 0), and B(i)=(0, 0, b_in(i)), and a blending display value (measured display value) Wp(i)=(Xw(i), Yw(i), Zw(i)) corresponding to a grayscale blending display value W(i)=(r_in(i), g_in(i), b_in(i)). The input components r_in(i), g_in(i), and b_in(i) may be same values. For different variables i0 and i1, the input components c_in(i0) and c_in(i1) may be different, where c represents one of r, g, and b.

A modifying module for a color tracking system is also provided according to an embodiment of the present invention. The color tracking system includes a color meter and a processing module. The color meter measures colors displayed on a panel. The modifying module includes an interface module, a comparing module, a distributing module, and a compensating module. According to a measurement result of the panel by the color meter, the interface module obtains a set of measured display values including a plurality of monochromatic display components and a grayscale blending display component. The comparing module provides an offset value according to a difference between the grayscale blending display component and the monochromatic display components. The distributing module sets a corresponding distribution ratio for each monochromatic display component, and calculates a corresponding monochromatic modification value for each of the monochromatic display component according to the distribution ratio corresponding to each of the monochromatic display component. The compensating module calculates a corresponding modified monochromatic display component for each of the monochromatic display component according to a sum of each of the monochromatic display component and the corresponding monochromatic modification value, and replaces the monochromatic display component in the set of measured display values with the corresponding modified monochromatic display component to provide a set of modified display values. According to the set of modified display values, the processing module of the color tracking system obtains a display setting via a setting value algorithm for the panel to display.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
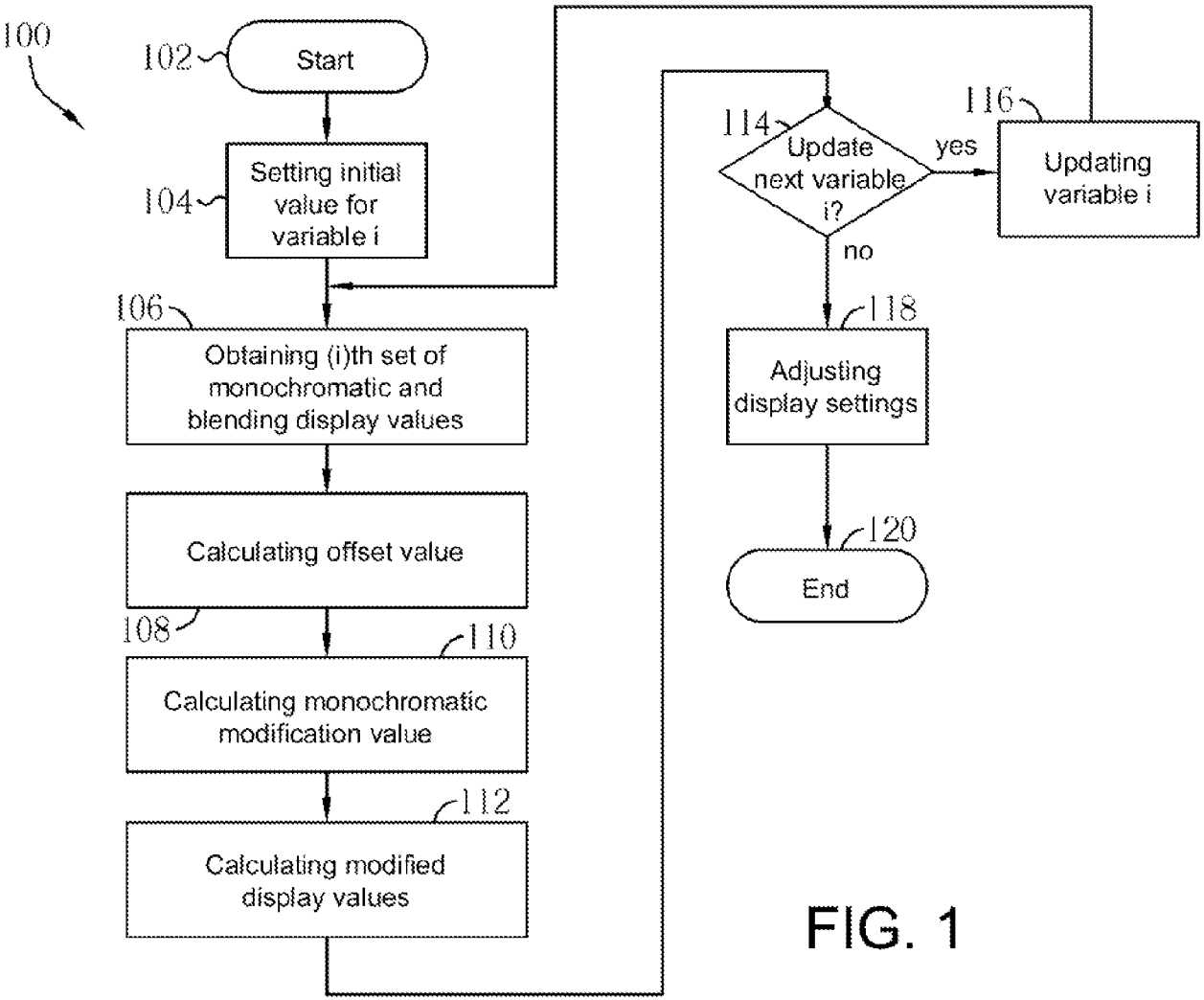
FIG. 1 is a flowchart of a flow for modifying display values according to an embodiment of the present invention.

FIG. 1 shows a flowchart of a process 100 for performing color tracking on a panel according to an embodiment of the present invention.

The process 100 begins with Step 102.

In Step 104, an initial value of a variable i is set.

In Step 106, a color meter is utilized to measure monochromatic display values Rp(i)=(Xr(i), Yr(i), Zr(i)), Gp(i)=(Xg(i), Yg(i), Zg(i)), Bp(i)=(Xb(i), Yb(i), Zb(i)), as well as a blending display value Wp(i)=(Xw(i), Yw(i), Zw(i)). In an embodiment of the present invention, the monochromatic display values Rp(i)=(Xr(i), Yr(i), Zr(i)), Gp(i)=(Xg(i), Yg(i), Zg(i)), and Bp(i)=(Xb(i), Yb(i), Zb(i)) are values measured by the color meter when three monochromatic input values are R(i)=(r_in(i), 0, 0), G(i)=(0, g_in(i), 0), and B(i)=(0, 0, b_in(i)); the blending display value Wp(i)=(Xw(i), Yw(i), Zw(i)) is a value measured when a blending input value is W(i)=(r_in(i), g_in(i),b_in(i)). The input components r_in(i), g_in(i), and b_in(i) are values between 0 and 255, and may all be a same value. For example, the input components may be r_in(i)=g_in(i)=b_in(i)=min(22, 256-32*i), where i=0 to 8 and the function min(a, b) selects the smaller value between the inputs a and b.

In Step 108, a bias value ΔKw(i) is calculated according to monochromatic values Kr(i), Kg(i), and Kb(i) (where K represents one of X, Y, and Z) as well as a blending display value Kw(i), so that Kr(i)+Kg(i)+Kb(i)+ΔKw(i)=Kw(i).

In Step 110, according to a distribution ratio Ksc(i) corresponding to the monochromatic display value Kc(i) and the offset value ΔKw(i), a monochromatic modification value ΔKc(i) corresponding to the monochromatic display value Kc(i) is obtained. For example, ΔKc(i)=ΔKw(i)*Ksc(i), where K represents one of X, Y, and Z, c represents one of r, g, and b, and a sum Ksr(i)+Ksg(i)+Ksb(i) of the distribution ratios equals 1.

According to an embodiment of the present invention, a distribution ratio Ksc(i) may be set according to a relative ratio of the monochromatic components Kr(i), Kg(i), and Kb(i). For example, it is set that Ksc(i)=Kc(i)/(Kr(i)+Kg(i)+Kb(i)), where K represents one of X, Y, and Z, and c represents one of r, g, and b.

According to another embodiment of the present invention, monochromatic display components Yr(i), Yg(i), and Yb(i) associated with brightness may serve as reference monochromatic display components, so as to set the distribution ratio Ksc(i) for each of the monochromatic display component according to the relative ratio of the reference monochromatic display components. For example, distribution ratios Ysr(i), Ysg(i), and Ysb(i) corresponding to the monochromatic display components Yr(i), Yg(i), and Yb(i) are respectively set to Yr(i)/(Yr(i)+Yg(i)+Yb(i)), Yg(i)/(Yr(i)+Yg(i)+Yb(i)) and Yb(i)/(Yr(i)+Yg(i)+Yb(i)) that prevail, so that the distribution ratios of the other two sets of monochromatic display components must equal to the distribution ratio of the display component Yc(i) associated with brightness. That is, Xsr(i)=Zsr(i)=Ysr(i), Xsg(i)=Zsg(i)=Ysg(i), and Xsb(i)=Zsb(i)=Ysb(i). Since the display component Yc(i) is associated with brightness to which human eyes are quite sensitive, the monochromatic display components Yr(i), Yg(i), and Yb(i) may then serve as reference monochromatic display components to determine distribution ratios Xsc(i) and Zsc(i) corresponding to other display components Xc(i) and Zc(i), where c represents one of r, g, and b. This embodiment is aiming at reducing costs and resources needed for realizing the process 100.

According to another embodiment of the present invention, monochromatic display components Yr(i0), Yg(i0), and Yb(i0) of a predetermined variable i0 may serve as reference monochromatic display components, so as to set the distribution ratio Ksc(i) for each monochromatic display component associated with another variable i according to the relative ratio of the reference monochromatic display components, where the variable i is different from the variable i0. For example, the distribution ratios Krs(i), Ksg(i), and Ksb(i) corresponding to the monochromatic display components Kr(i), Kg(i), and Kb(i) may be respectively equal to Yr(i0)/(Yr(i0)+Yg(i0)+Yb(i0)), Yg(i0)/(Yr(i0)+Yg(i0)+Yb(i0)), and Yb(i0)/(Yr(i0)+Yg(i0)+Yb(i0)), where K is X, Y, and Z. Alternatively, the distribution ratio Ksc(i) corresponding to the monochromatic display component Kc(i) may equal to Kc(i0)/(Kr(i0)+Kg(i0)+Kb(i0)). Input components r_in(i0), g_in(i0), and b_in(i0) corresponding to the variable i0 may all be 255. That is to say, the measured display values (Xr(i0), Yr(i0),Zr(i0)), (Xg(i0),Yg(i0),Zg(i0)), and (Xb(i0),Yb(i0), Zb(i0)) may be measured values when three monochromatic input values are respectively (255, 0, 0), (0, 255, 0), and (0, 0, 255).

According to another embodiment of the present invention, the distribution ratios Ksr(i), Ksg(i), and Ksb(i) may also be constants instead of being determined by the measurement result. This embodiment is capable of further reducing costs and resources needed for realizing the process 100.

In Step 112, a modified monochromatic display component Kc_m(i) is provided for each of the monochromatic display component Kc(i) according to the monochromatic display component Kc(i) of the monochromatic display value and the corresponding monochromatic modification value ΔKc(i). For example, the modified monochromatic display component is set to Kc_m(i)=Kc(i)+ΔKc(i), where K represents one of X, Y, and Z, and c represents one of r, g, and b. After the modification, a sum Kr_m(i)+Kg_m(i)+Kb_m(i) of the modified monochromatic display components Kr_m(i), Kg_m(i), and Kb_m(i) is then consistent with the grayscale blending display component Kw(i), where K represents one of X, Y, and Z.

In Step 114, Step 116 is then performed when there is a monochromatic display component of another variable i to be modified, or else Step 118 is then performed. The variable i may be several sampling points, and is not necessary a value that is required for adjusting the display setting. For example, supposing an Nc number of display values are required for adjusting display settings, Steps 106 to 120 may only be performed for an Np number of times on Np blending display values (and corresponding monochromatic display values), where Np<Nc. The remaining (Nc−Np) display values for adjusting the display setting may be estimated by interpolation or other calculations.

In Step 116, the value of the variable i is updated and Step 106 is iterated to start modifying another set of monochromatic display components Kc(i). When the modified monochromatic display components Kc_m(i) for the monochromatic display components are all obtained, interpolation or other approaches may also be adopted to calculate the remaining values required for adjusting the display setting.

In Step 118, the display settings are calculated and/or adjusted with a setting value algorithm according to the modified monochromatic display components, so as to allow the panel to display a consistent color temperature at each of the grayscales.

The process 100 ends in Step 120 to complete color tracking of the panel.

Figure 2:
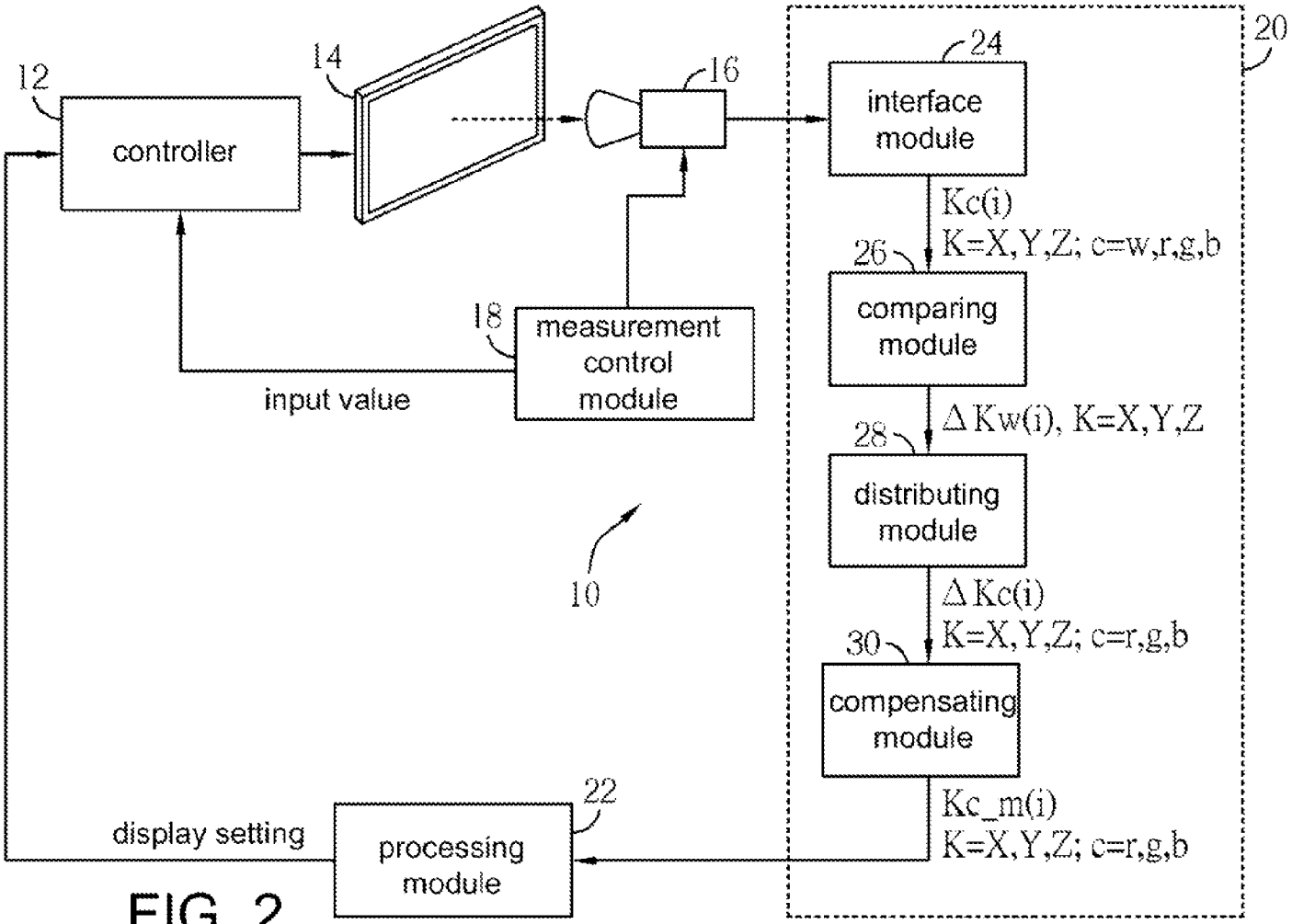
FIG. 2 is a schematic diagram of a color tracking system according to an embodiment of the present invention.

FIG. 2 shows a schematic diagram of a color tracking system 10 according to an embodiment of the present invention. For a panel 14 and a corresponding controller 12, the color tracking system 10 includes a color meter 16, a measurement control module 18, a modifying module 20, and a processing module 22. The color meter 16 measures colors displayed on the panel 14. The measurement control module 18 controls color measurement needed for color tracking. By inputting predetermined input values into the controller 12, the measurement control module 18 enables the panel 14 to display test patterns and the color meter 16 to correspondingly measure the colors displayed on the panel 14.

The modifying module 20 includes an interface module 24, a comparing module 26, a distributing module 28, and a compensating module 30. The modifying module 20 is configured to realize the process 100 in FIG. 1. The interface module 24 obtains a set of measured display values according to a measurement of the panel 14 by the color meter 16. The set of measured display values comprises a plurality of monochromatic display components Kr(i), Kg(i), and Kb(i) as well as a grayscale blending display component Kw(i), where K represents one of X, Y, and Z. The comparing module 26 provides an offset value ΔKw(i) according to a difference between the grayscale blending display component Kw(i) and the monochromatic display components Kr(i), Kg(i), and Kb(i). The distributing module 28 sets a distribution ratio Ksc(i) corresponding to each of the monochromatic display component Kc(i), and provides a monochromatic modification value ΔKc(i) corresponding to each of the monochromatic display component according to the offset value ΔKw(i), where c represents one of r, g, and b. Various embodiments for the distributing module 28 to generate the distribution ratio may be deduced from the previous discussion of Step 110.

The compensating module 30 provides a modified monochromatic display component Kc_m(i) corresponding to each of the monochromatic display component Kc(i) according to a sum Kc(i)+ΔKc(i) of each of the monochromatic display component and the corresponding monochromatic modification value ΔKc(i), and replaces the monochromatic display component Kc(i) in the set of display values with a corresponding modified monochromatic display component Kc_m(i) to provide a set of modified display values. According to the modified display values, the processing module 22 obtains a display setting with a setting value algorithm. The display setting may be written into the controller so that the panel 14 is enabled to display according to the display setting. For example, the processing module 22 may be a computer.

The modifying module 20 may be implemented by any of or a combination of hardware, firmware, and software. The modifying module 20 may be integrated into the color meter 16 in an embodiment, or integrated into the processing module 22 in another embodiment. For example, the processing module 22 may further include a memory device (e.g., a volatile or a non-volatile memory, not shown) for storing a modifying code, which may be executed by the processing module 22 to fulfill functions of the modifying module 20. The modifying code may also be integrated into code of the setting value algorithm.

Figure 3:
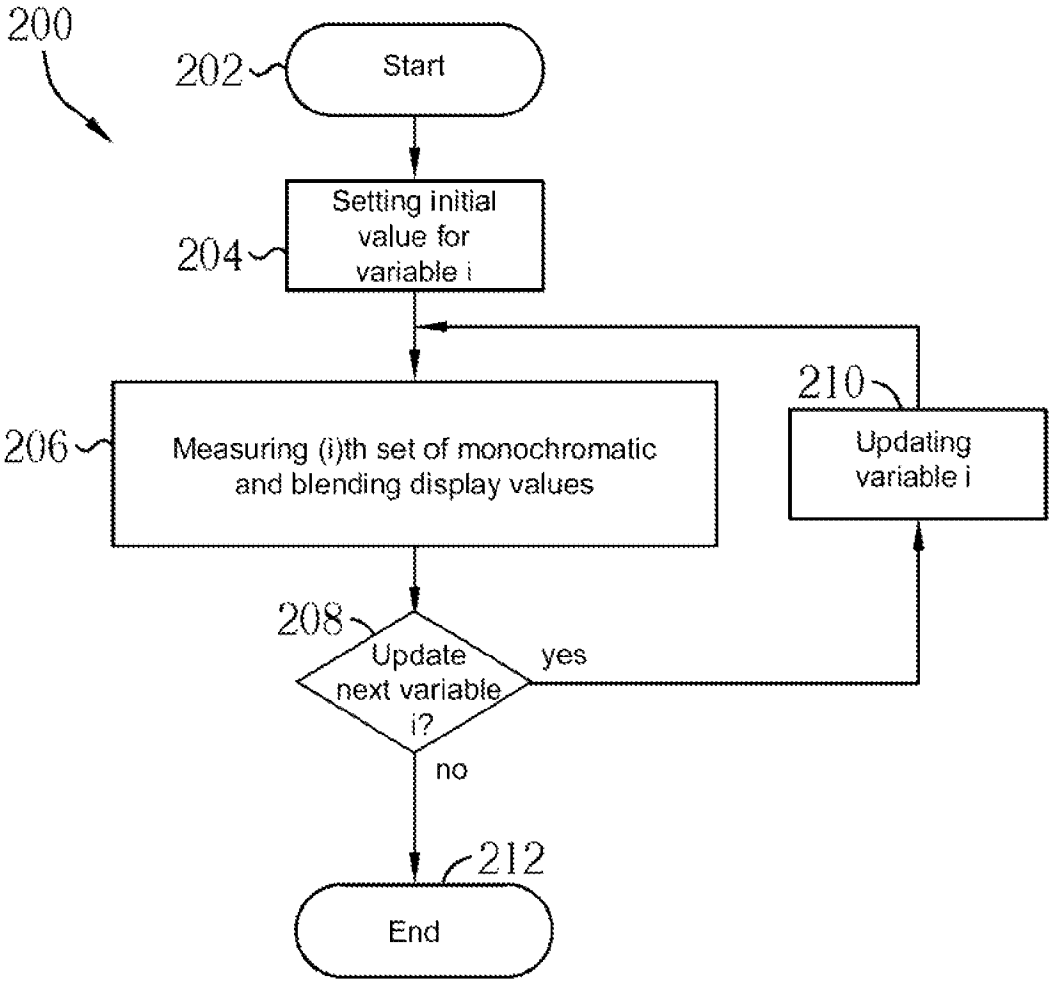
FIG. 3 is a flowchart of a measuring flow of a color meter according to an embodiment of the present invention.

FIG. 3 shows a flowchart of a process of obtaining monochromatic display values 200 according to an embodiment of the present invention. The measurement control module 18 may obtain the monochromatic display values Kc(i) and the blending display value Kw(i) of the modifying module 20 according to the process 200.

The process 200 begins with Step 202.

In Step 204, an initial value of a variable i is set.

In Step 206, the color meter 16 measures monochromatic display components Xr(i), Yr(i), and Zr(i) when the input value is R(i)=(r_in(i), 0, 0), measures monochromatic display components Xg(i), Yg(i), and Zg(i) when the input value is G(i)=(0, g_in(i), 0), measures monochromatic display components Xb(i), Yb(i), and Zb(i) when the input value is B(i)=(0, 0, b_in(i)), and measures grayscale blending display components Xw(i), Yw(i), and Zw(i) when the input value is W(i)=(r_in(i), g_in(i), b_in(i)). The input values R(i)=(r_in(i),0,0), G(i)=(0 μg_in(i),0) and B(i)=(0,0,b_in(i)) may be regarded as monochromatic input values, and the input value W(i)=(r_in(i), g_in(i), b_in(i)) may be regarded as a grayscale input value that is synthesized from the three corresponding monochromatic input values.

In Step 208, it is determined whether there are monochromatic/grayscale blending display components Kc(i) of another variable i to be measured (where c is one of r, g, and b). Step 210 is performed when a result is affirmative, or else Step 212 is performed.

In Step 210, a value of the variable i is updated and Step 206 is iterated.

The process 200 ends in Step 212 when i has reached its last (maximum) value.

Figure 4:
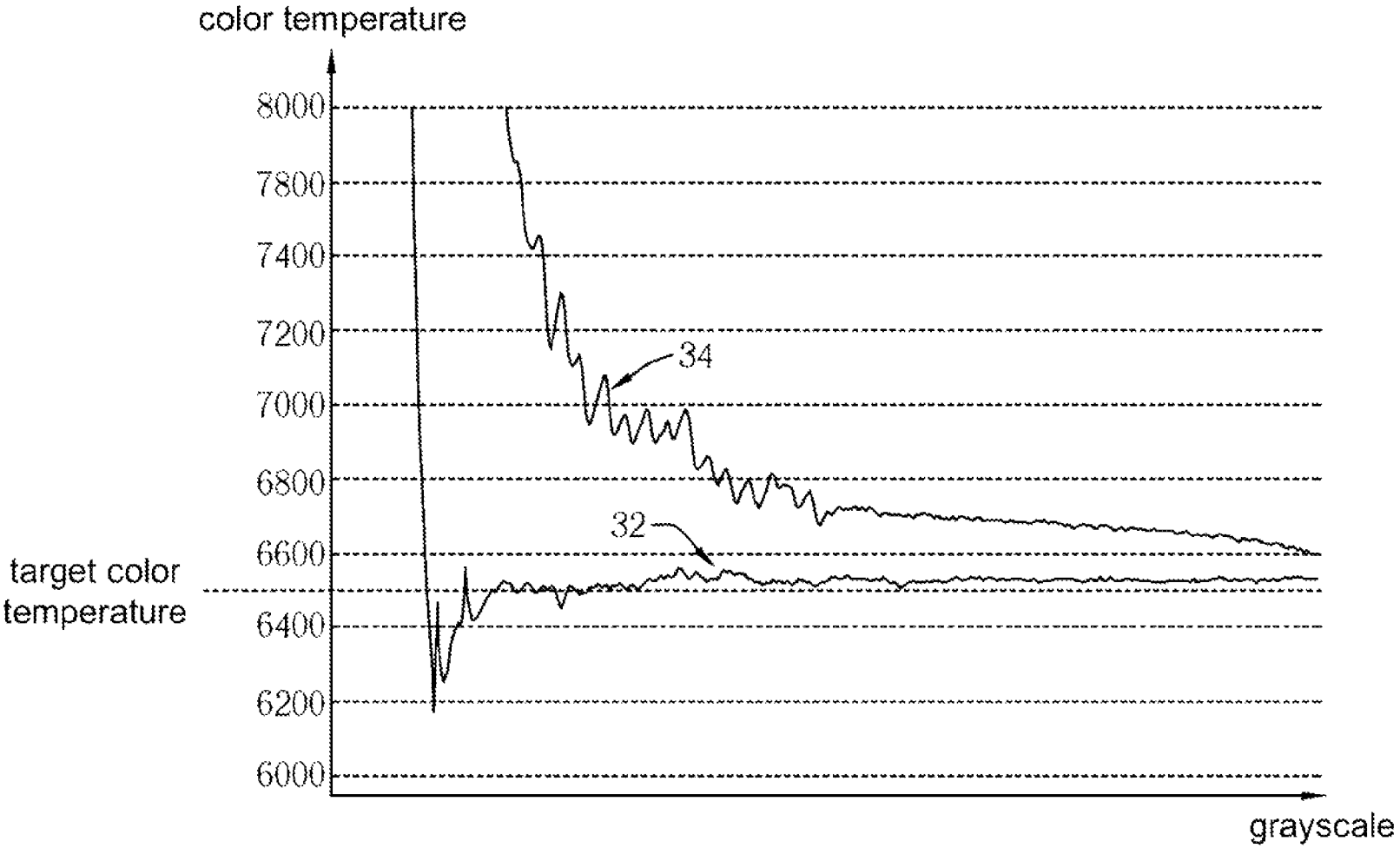
FIG. 4 is a schematic diagram of a color tracking result according to an embodiment of the present invention.

FIG. 4 shows a schematic diagram of a color tracking result according to an embodiment of the present invention. In FIG. 4, the horizontal axis represents grayscales (e.g., grayscales ranging from 0 to 255); the vertical axis represents color temperatures of the grayscales, in a unit of Kelvin degrees. A curve 32 shows color temperatures presented by the grayscales at the panel when displaying the display setting according to the modified display values of the present invention; a curve 34 shows color temperatures presented by the grayscales at the panel when displaying the display setting according to the prior art. Setting algorithms of the two curves calculate the display settings based on a same color temperature (e.g., 6500K degrees). However, as shown by the curve 34 of the prior art, the color temperatures of the grayscales, being inconsistent, are deviated from the target color temperature. In contrast, as shown by the curve 32 of the present invention, the color temperatures of the grayscales accurately approximate the target color temperature since the display values measured by the color meter are modified.

Therefore, it is illustrated with the above embodiments that, the present invention is capable of enhancing an accuracy of color tracking through modifying a measurement obtained by a color meter, so as to achieve the objective of color tracking as well as overcoming discrepancies between different panels.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A color tracking method for a panel, comprising:

obtaining a set of measured display values according to a measurement of the panel by a color meter;

modifying the set of measured display values to generate a set of modified display values;

calculating a display setting according to the set of modified display values for the panel to display according to the display setting;

calculating a display component sum according to a sum of monochromatic display components;

generating an offset value according to a difference between a grayscale blending display value and the display component sum;

setting a distribution ratio corresponding to each of the monochromatic display components; and calculating a monochromatic modification value according to the distribution ratio corresponding to each of the monochromatic display components and the offset value.

2. The method according to claim 1, further comprising:

calculating a corresponding modified monochromatic display component according to each of the monochromatic display components and the corresponding monochromatic modification value; and replacing the monochromatic display components with the corresponding modified monochromatic display components in the set of modified display components.

3. The method according to claim 1, further comprising:

setting the corresponding distribution ratio for the monochromatic display components according to a relative ratio of the monochromatic display components.

4. The method according to claim 1, further comprising:

designating a predetermined number of the monochromatic display components as reference monochromatic display components; and setting the corresponding distribution ratio for each of the monochromatic display components according to a relative ratio of the reference monochromatic display components.

5. The method according to claim 1, wherein the set of measured display values comprises monochromatic display components and a grayscale blending display component, and the method further comprises:

generating a corresponding modified monochromatic display component for each of the monochromatic display components according to the monochromatic display components and the grayscale blending display component, wherein a sum of the modified monochromatic display components matches the grayscale blending display component; and replacing the monochromatic display components with the corresponding modified monochromatic display components in the set of modified display components.

6. A modifying module applied to a color tracking system, the color tracking system comprising a color meter for measuring colors displayed by a panel, the modifying module comprising:

an interface module, for obtaining a set of measured display values according to a measurement of the panel by the color meter, the set of measured display values comprising a plurality of monochromatic display components and a grayscale display component;

a comparing module, for calculating an offset value according to a difference between the grayscale display component and a sum of the monochromatic display components; and a compensating module, for providing a corresponding modified monochromatic display component for each of the monochromatic display components according to the offset value, and replacing the monochromatic display components in the set of measured display values with the modified monochromatic display components to generate a set of modified display values.

7. The modifying module according to claim 6, further comprising:

a distributing module, for calculating a corresponding monochromatic modification value for each of the monochromatic display components according to the offset value;

wherein, the compensating module calculates the modified monochromatic display component according to each of the monochromatic display components and a sum of the corresponding monochromatic modification value.

8. The modifying module according to claim 7, wherein the distributing module further sets a corresponding distribution ratio for each of the monochromatic display components, and calculates the corresponding monochromatic modification value according to the corresponding distribution ratio of each of the monochromatic display components and the offset value.

9. The modifying module according to claim 6, wherein the color tracking system further comprises a processing module for obtaining a display setting according to the set of modified display values for the panel to display according to the display setting.

10. A color tracking method for a panel, comprising:

obtaining a set of measured display values according to a measurement of the panel by a color meter, wherein the set of measured display values comprises a plurality of monochromatic display components and a grayscale blending display component;

modifying the set of measured display values to generate a set of modified display values;

calculating a display setting according to the set of modified display values for the panel to display according to the display setting.

providing a monochromatic modification value corresponding to each of the monochromatic display components according to a difference between the grayscale blending display component and the monochromatic display components; and modifying the corresponding measured display value according to each of the monochromatic display components and the corresponding monochromatic modification value to generate the set of modified display values.

* * * * *